US006146236A

United States Patent [19]

Kay

[11] Patent Number: 6,146,236

[45] Date of Patent: Nov. 14, 2000

[54] NOISEMAKER

[76] Inventor: Cliff Kay, 1605 Howell Ave., La Marque, Tex. 77568

[21] Appl. No.: 09/301,782

[22] Filed: Apr. 29, 1999

[51] Int. Cl.[7] ..... A63H 5/00

[52] U.S. Cl. ..... 446/419; 446/397; 446/418; 446/421

[58] Field of Search ..... 446/397, 421, 446/419, 418, 422, 81; 84/402, 403, 406

[56] References Cited

U.S. PATENT DOCUMENTS

| | | | |
|---|---|---|---|
| 2,289,314 | 7/1942 | Davis | 446/419 |
| 2,318,460 | 5/1943 | Brief | 446/419 |
| 2,430,318 | 11/1947 | Zimmerman | 446/419 |
| 4,901,617 | 2/1990 | Malone et al. | 84/402 |
| 5,808,215 | 9/1998 | Kralik et al. | 446/419 |

*Primary Examiner*—Jacob K. Ackun
*Assistant Examiner*—Urszula M. Cegielnik

[57] ABSTRACT

A noisemaker for producing a drumming sound when shaken rapidly back and forth. The noisemaker includes a head with a spaced apart pair of faces and an outwardly extending tubular extent which terminates at an open end. A plurality of resiliently deformable balls are provided in the head. The extent is inserted into one end of a handle.

17 Claims, 2 Drawing Sheets

NOISEMAKER

BACKGROUND OF THE INVENTION

1. Field of the Invention

The present invention relates to hand held noisemakers and more particularly pertains to a new noisemaker for producing a drumming sound when shaken rapidly back and forth.

2. Description of the Prior Art

The use of hand held noisemakers is known in the prior art. More specifically, hand held noisemakers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,266,459; U.S. Pat. No. 5,073,139; U.S. Pat. No. Des. 376,625; U.S. Pat. No. Des. 298,543; U.S. Pat. No. Des. 317,953; and U.S. Pat. No. 4,075,922.

While these devices fulfill their respective, particular objectives and requirements, the aforementioned patents do not disclose a new noisemaker. The inventive device includes a head with a spaced apart pair of faces and an outwardly extending tubular extent which terminates at an open end. A plurality of resiliently deformable balls are provided in the head. The extent is inserted into one end of a handle.

In these respects, the noisemaker according to the present invention substantially departs from the conventional concepts and designs of the prior art, and in so doing provides an apparatus primarily developed for the purpose of producing a drumming sound when shaken rapidly back and forth.

SUMMARY OF THE INVENTION

In view of the foregoing disadvantages inherent in the known types of hand held noisemakers now present in the prior art, the present invention provides a new noisemaker construction wherein the same can be utilized for producing a drumming sound when shaken rapidly back and forth.

The general purpose of the present invention, which will be described subsequently in greater detail, is to provide a new noisemaker apparatus and method which has many of the advantages of the hand held noisemakers mentioned heretofore and many novel features that result in a new noisemaker which is not anticipated, rendered obvious, suggested, or even implied by any of the prior art hand held noisemakers, either alone or in any combination thereof.

To attain this, the present invention generally comprises a head with a spaced apart pair of faces and an outwardly extending tubular extent which terminates at an open end. A plurality of resiliently deformable balls are provided in the head. The extent is inserted into one end of a handle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new noisemaker apparatus and method which has many of the advantages of the hand held noisemakers mentioned heretofore and many novel features that result in a new noisemaker which is not anticipated, rendered obvious, suggested, or even implied by any of the prior art hand held noisemakers, either alone or in any combination thereof.

It is another object of the present invention to provide a new noisemaker which may be easily and efficiently manufactured and marketed.

It is a further object of the present invention to provide a new noisemaker which is of a durable and reliable construction.

An even further object of the present invention is to provide a new noisemaker which is susceptible of a low cost of manufacture with regard to both materials and labor, and which accordingly is then susceptible of low prices of sale to the consuming public, thereby making such noisemaker economically available to the buying public.

Still yet another object of the present invention is to provide a new noisemaker which provides in the apparatuses and methods of the prior art some of the advantages thereof, while simultaneously overcoming some of the disadvantages normally associated therewith.

Still another object of the present invention is to provide a new noisemaker for producing a drumming sound when shaken rapidly back and forth.

Yet another object of the present invention is to provide a new noisemaker which includes a head with a spaced apart pair of faces and an outwardly extending tubular extent which terminates at an open end. A plurality of resiliently deformable balls are provided in the head. The extent is inserted into one end of a handle.

Still yet another object of the present invention is to provide a new noisemaker that lets a user make a drumming sound with a hand held device that is easily portable.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
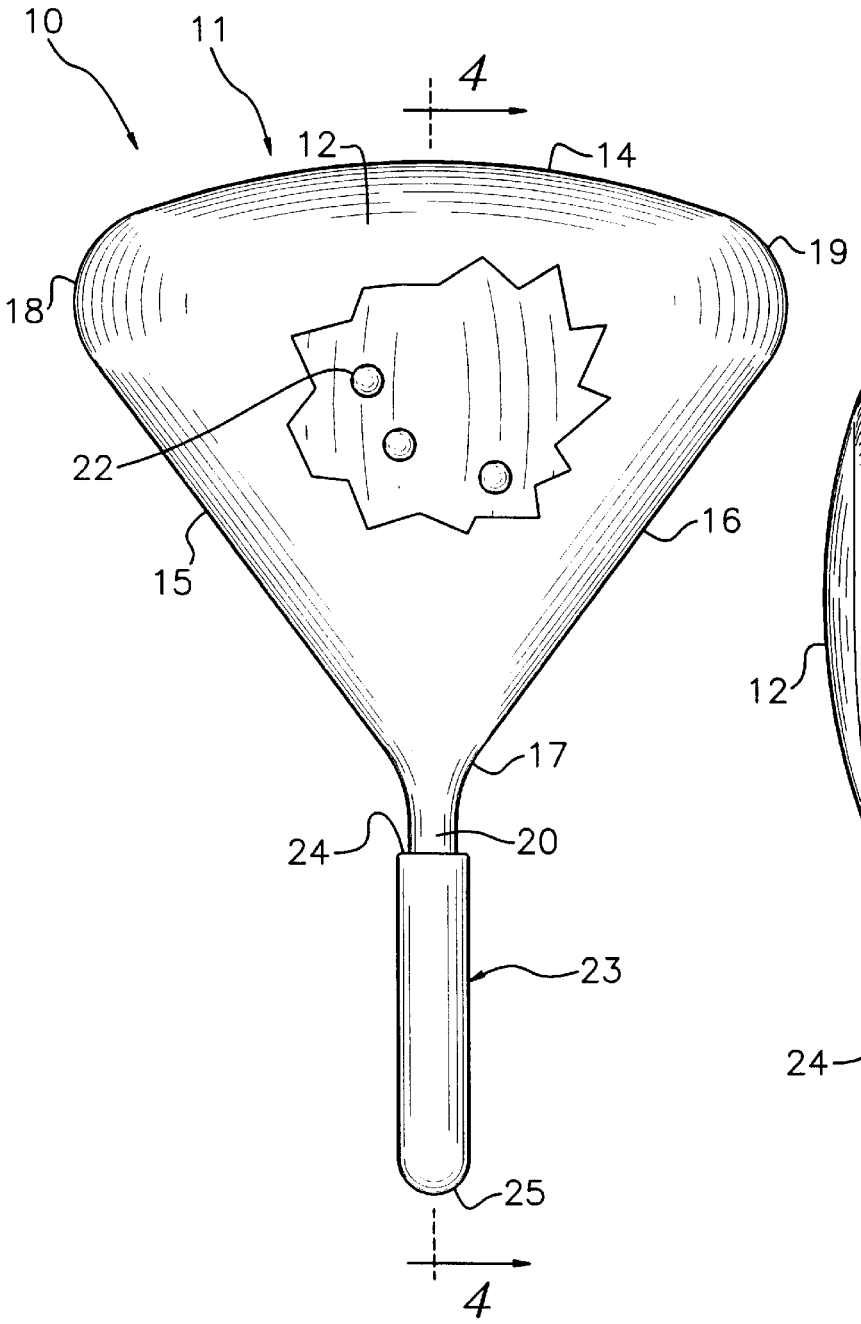
FIG. 1 is a schematic breakaway plan view of a new noisemaker according to the present invention.
Figure 2:
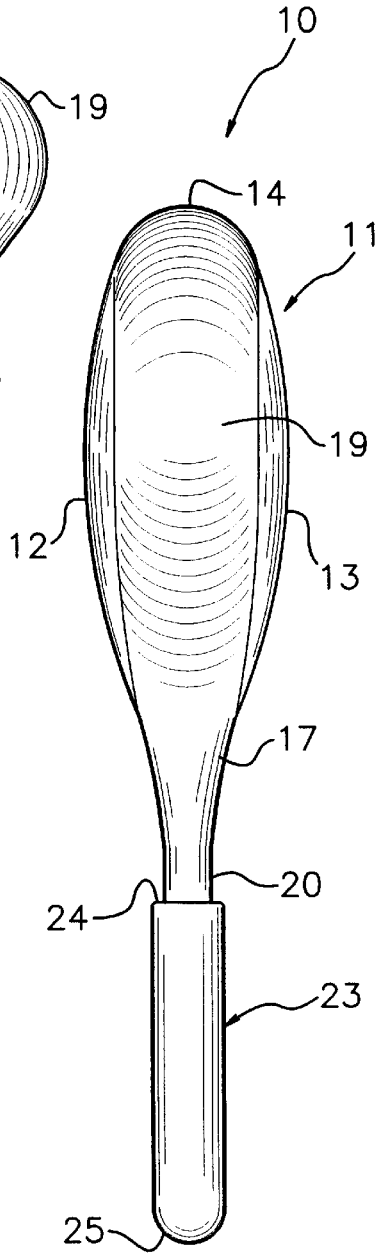
FIG. 2 is a schematic side view of the present invention.
Figure 3:
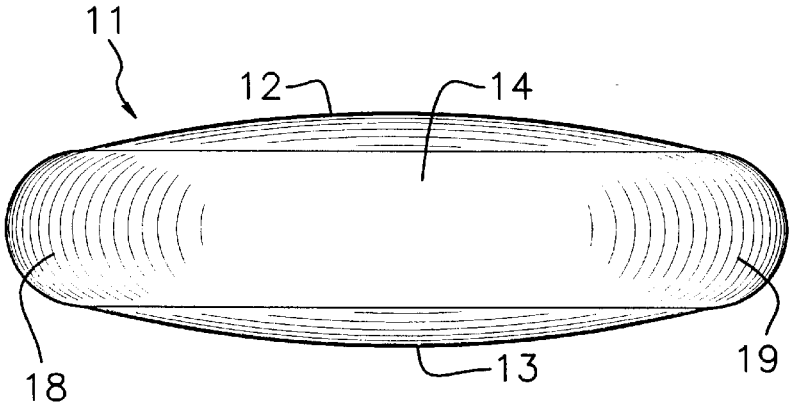
FIG. 3 is a schematic end view of the present invention.

With reference now to the drawings, and in particular to FIGS. 1 through 4 thereof, a new noisemaker embodying the principles and concepts of the present invention and generally designated by the reference numeral 10 will be described.

As best illustrated in FIGS. 1 through 4, the noisemaker 10 generally comprises a head with a spaced apart pair of faces and an outwardly extending tubular extent which terminates at an open end. A plurality of resiliently deformable balls are provided in the head. The extent is inserted into one end of a handle.

In closer detail, the noisemaker 10 comprises a generally triangular hollow head 11 having a spaced apart pair of generally triangular faces 12,13, and a generally triangular outer perimeter comprising three sides 14,15,16 and three vertices 17,18,19. The head has an generally cylindrical tubular extent 20 outwardly extending from a first of the vertices 17 of the head. The extent of the head terminates at an open end 21. The head has an axis extending between the first vertex of the head and a first of the sides 14 of the head opposite the first vertex of the head. The extent is substantially coaxial with the axis of the head with the open end of the extent lying in a plane substantially perpendicular to the axis of the head.

Figure 4:
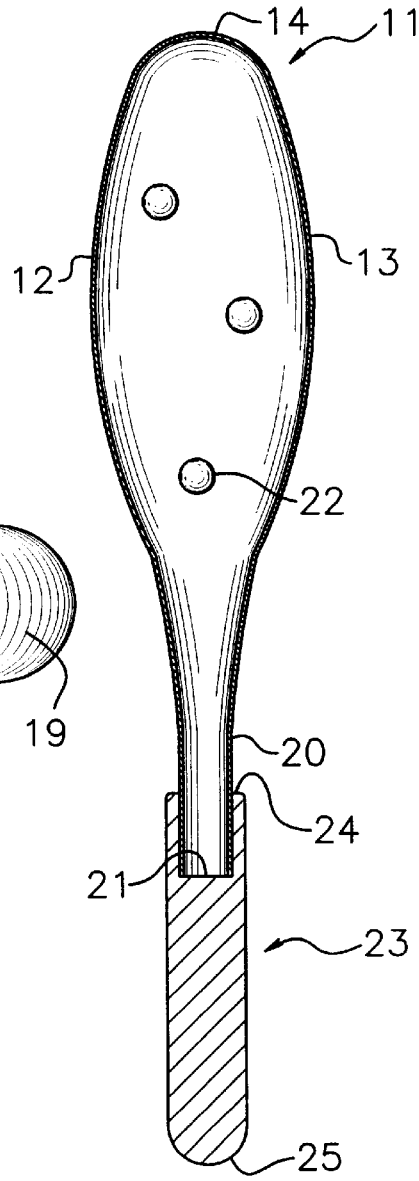
FIG. 4 is a schematic cross sectional view of the present invention taken from line 4—4 of FIG. 1.

With reference to FIG. 4, the faces of the head are curved so that they are slightly dome-shaped such that the faces of the head each has an arcuate cross section taken in a first plane in which the axis of the head lies and generally perpendicular to the faces of the head. These arcuate cross sections of the faces of the head have inwardly facing concavities facing one another. The outer perimeter of the head has an arcuate cross section taken in the first plane which also has an inwardly facing concavity. The concavities of the arcuate cross sections of the faces and the outer perimeter of the head each have a radius of curvature with the radius of curvature of the arcuate cross section of the outer perimeter of the head being greater than the radius of curvature of the arcuate cross section of each face of the head.

With reference to FIG. 1 the first side has an arcuate cross section taken in a second plane in which the axis of the head lies substantially perpendicular to the first plane. The arcuate cross section of the first side of the head has a concavity facing towards the first vertex of the head. In this plane the vertices of the head are rounded with concavities facing into the head. The concavities of the arcuate cross sections of the first side and the vertices of the head each have a radius of curvature with the radius of curvature of the arcuate cross section of the first side being greater than the radius of curvature of the arcuate cross section of each vertex of the head.

In a preferred embodiment, the head comprises a resonating plastic material such as drum plastic used to make drum heads which produces a resonant sound when struck by an object. Optionally, the head may comprise a rigid leather material which also produces a resonant sound when struck by an object.

The head has an outermost width defined between second and third vertices 18,19 of the head, and an outermost thickness defined between the faces of the head. The outermost width is greater than the outermost thickness. In an ideal illustrative embodiment, the outermost width is between about 11 inches and about 13 inches and the outermost thickness is between about 2 inches and about 2½ inches to provide an optimal drum-like sound when the head is struck.

A plurality of resiliently deformable generally spherical balls 22 are provided in the interior of the head. The balls each comprises a resiliently deformable rubber material. Ideally, the balls each have an outer diameter of about 1 inch. Ideally, the plurality of balls in the head is only two or three balls to provide the optimal drumming sound. In use, shaking the head rapidly back and forth causes the balls to strike the faces to cause the faces to resonate and produce a drumming sound.

A generally cylindrical handle 23 is provided with a pair of opposite ends 24,25 and a longitudinal axis extending between the ends of the handle. A first of the ends 24 of the handle has a generally cylindrical bore therein. The free end of the extent is inserted into the bore of the first end of the handle to coupled the extent to the handle. The longitudinal axis of the handle and the axis of the head are preferably substantially coaxial. Ideally, a second of the ends of the handle is rounded for helping prevent injury from contact with the second end of the handle. The handle has a length defined along the longitudinal axis of the handle between the ends of the handle. Ideally, the length of the handle is between about 5 inches and about 6 inches for providing an optimal size for comfortable grasping with a hand of a user. The bore of the handle has a length along the longitudinal axis of the handle less than about one-half of the length of the handle and ideally between about 1 inch and about 2 inches.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A noisemaker, comprising:

a head having a spaced apart pair of faces;

said head having an generally cylindrical tubular extent outwardly extending therefrom;

said extent of said head terminating at an open end;

a plurality of resiliently deformable halls being provided in said head;

a handle having a pair of opposite ends and a longitudinal axis extending between said ends of said handle;

a first of said ends of said handle receiving said extend therein;

said head having a thickness between said faces greater than a diameter of said handle, such that the balls are provided with a greater distance between said faces for movement before striking one of said faces;

wherein said head has a generally triangular outer perimeter comprising three sides and three vertices said extent outwardly extending from a first of said vertices of said head; and wherein said head has an axis extending between said first vertex of said head and a first of said sides of said head opposite said first vertex of said head, said extent being substantially coaxial with said axis of said head, said open end of said extent lying in a plane substantially perpendicular to said axis of said head.

2. The noisemaker of claim 1, wherein said faces of said head being curved so that they are slightly dome-shaped such that said faces of said head each having an arcuate cross section taken in a first plane in which said axis of said head lies and generally perpendicular to said faces of said head, arcuate cross sections of said faces of said head having inwardly facing concavities facing one another, wherein said outer perimeter of said head has an arcuate cross section taken in said first plane, said arcuate cross section of said outer perimeter of said head having an inwardly facing concavity.

3. The noisemaker of claim 2, wherein said concavities of said arcuate cross sections of said faces and said outer perimeter of said head each have a radius of curvature, said radius of curvature of said arcuate cross section of said outer perimeter of said head being greater than said radius of curvature of said arcuate cross section of each face of said head.

4. The noisemaker of claim 2, wherein said first side has an arcuate cross section taken in a second plane in which said axis of said head lies substantially perpendicular to said first plane, said arcuate cross section of said first side of said head having a concavity facing towards said first vertex of said head, said vertices of said head being rounded and having concavities facing into said head.

5. The noisemaker of claim 4, wherein said concavities of said arcuate cross sections of said first side and said vertices of said head each have a radius of curvature, said radius of curvature of said arcuate cross section of said first side being greater than said radius of curvature of said arcuate cross section of each vertex of said head.

6. The noisemaker of claim 1, wherein head comprises a resonating plastic material.

7. The noisemaker of claim 1, wherein said head comprises a rigid leather material which produces a resonant sound when struck by an object.

8. The noisemaker of claim 1, wherein said plurality of balls consists of three balls.

9. A noisemaker, comprising:

a generally triangular hollow head having a spaced apart pair of generally triangular faces, and a generally triangular outer perimeter comprising three sides and three vertices;

said head having an generally cylindrical tubular extent outwardly extending from a first of said vertices of said head;

said extent of said head terminating at an open end;

said head having an axis extending between said first vertex of said head and a first of said sides of said head opposite said first vertex of said head;

said extent being substantially coaxial with said axis of said head, said open end of said extent lying in a plane substantially perpendicular to said axis of said head;

said faces of said head each having an arcuate cross section taken in a first plane in which said axis of said head lies and generally perpendicular to said faces of said head;

arcuate cross sections of said faces of said head having inwardly facing concavities facing one another;

said outer perimeter of said head having an arcuate cross section taken in said first plane, said arcuate cross section of said outer perimeter of said head having an inwardly facing concavity;

said concavities of said arcuate cross sections of said faces and said outer perimeter of said head each having a radius of curvature, said radius of curvature of said arcuate cross section of said outer perimeter of said head being greater than said radius of curvature of said arcuate cross section of each face of said head;

said first side having an arcuate cross section taken in a second plane in which said axis of said head lies substantially perpendicular to said first plane;

said arcuate cross section of said first side of said head having a concavity facing towards said first vertex of said head;

said vertices of said head being rounded and having concavities facing into said head;

said concavities of said arcuate cross sections of said first side and said vertices of said head each having a radius of curvature, said radius of curvature of said arcuate cross section of said first side being greater than said radius of curvature of said arcuate cross section of each vertex of said head;

said head comprising a resonating plastic material;

said head having an outermost width defined between second and third vertices of said head, and an outermost thickness defined between said faces of said head;

said outermost width being greater than said outermost thickness;

wherein said outermost width is between about 11 inches and about 13 inches and said outermost thickness is between about 2 inches and about 2½ inches;

a plurality of resiliently deformable generally spherical balls being provided in said head, said balls each comprising a resiliently deformable rubber material, said balls each having an outer diameter of about 1 inch;

a generally cylindrical handle having a pair of opposite ends and a longitudinal axis extending between said ends of said handle;

a first of said ends of said handle having a generally cylindrical bore therein;

said free end of said extent being inserted into said bore of said first end of said handle to coupled said extent to said handle;

said longitudinal axis of said handle and said axis of said head being substantially coaxial;

a second of said ends of said handle being rounded; and said handle having a length defined along said longitudinal axis of said handle between said ends of said handle, wherein said length of said handle is between about 5 inches and about 6 inches.

10. The noisemaker of claim 1, wherein said handle has a bore, said bore of said handle having a length along said longitudinal axis of said handle less than about one-half of said length of said handle and ideally between about 1 inch and about 2 inches.

11. A noisemaker, comprising:

a head having a spaced apart pair of faces;

said head having an generally cylindrical tubular extent outwardly extending therefrom;

said extent of said head terminating at an open end;

a plurality of resiliently deformable balls being provided in said head;

a handle having a pair of opposite ends and a longitudinal axis extending between said ends of said handle;

a first of said ends of said handle receiving said extent therein;

said head having a thickness between said faces greater than a diameter of said handle, such that the balls are provided with a greater distance between said faces for movement before striking one of said faces; and wherein said plurality of balls consists of three balls.

12. The noisemaker of claim 11, wherein said faces of said head being curved so that they are slightly dome-shaped such that said faces of said head each having an arcuate cross section taken in a first plane in which said axis of said head lies and generally perpendicular to said faces of said head, arcuate cross sections of said faces of said head having inwardly facing concavities facing one another, wherein said outer perimeter of said head has an arcuate cross section taken in said first plane, said arcuate cross section of said outer perimeter of said head having an inwardly facing concavity.

13. The noisemaker of claim 12, wherein said concavities of said arcuate cross sections of said faces and said outer perimeter of said head each leave a radius of curvature, said radius of curvature of said arcuate cross section of said outer perimeter of said head being greater than said radius of curvature of said arcuate cross section of each face of said head.

14. The noisemaker of claim 12, wherein said first side has an arcuate cross section taken in it second plane in which said axis of said head lies substantially perpendicular to said first plane, said arcuate cross section or said first side of said head having a concavity facing towards said first vertex of said head said vertices of said head being rounded and having concavities facing into said head.

15. The noisemaker of claim 14, wherein said concavities of said arcuate cross sections of said first side and said vertices of said head each have a radius of curvature, said radius of curvature of said arcuate cross section of said first side being greater than said radius of curvature of said arcuate cross section of each vertex of said head.

16. The noisemaker of claim 11, wherein head comprises a resonating plastic material.

17. The noisemaker of claim 11, wherein said head comprises a rigid leather material which produces a resonant sound when struck by an object.

* * * * *